US005327735A

United States Patent [19]

Hatton

[11] Patent Number: 5,327,735

[45] Date of Patent: Jul. 12, 1994

[54] REFRIGERANT RECLAIMING AND RECYCLING SYSTEM WITH EVAPORATOR CHILL BATH

[75] Inventor: Bobby L. Hatton, Butler County, Mo.

[73] Assignee: The Youngstown Research & Development Co., Norwalk, Calif.

[21] Appl. No.: 782,987

[22] Filed: Oct. 28, 1991

[51] Int. Cl.[5] ..... F25B 45/00

[52] U.S. Cl. ..... 62/292; 62/77

[58] Field of Search ..... 62/77, 85, 149, 292, 62/475

[56] References Cited

U.S. PATENT DOCUMENTS

| | | | |
|---|---|---|---|
| 4,441,330 | 4/1984 | Lower et al. | 62/149 |
| 4,476,688 | 10/1984 | Goddard | 62/292 |
| 4,646,527 | 3/1987 | Taylor | 62/292 |
| 4,903,499 | 2/1990 | Merritt | 62/149 |
| 4,942,741 | 7/1990 | Hancock et al. | 62/77 |
| 5,090,211 | 2/1992 | Peters | 62/149 |
| 5,150,577 | 9/1992 | Mitchell et al. | 62/292 |
| 5,189,881 | 3/1993 | Miles | 62/292 |

*Primary Examiner*—John M. Sollecito

*Attorney, Agent, or Firm*—Webb, Burden, Ziesenheim & Webb

[57] ABSTRACT

The present invention relates to a refrigerant recycling and reclaiming system capable of removing refrigerant from a refrigeration machine for filtering and reclaiming of the refrigerant, whereupon the refrigerant can be either stored or reintroduced into the refrigeration machine and reused rather than being lost to the atmosphere or otherwise wasted. The recycling and reclaiming system of the present invention is characterized in that it includes an evaporator and/or refrigerant storage tank which are contained within a thermal barrier, typically a water bath, which permits the system to operate at lower temperatures and pressures than systems heretofore known in the art. Lower temperatures and pressures in turn require a much smaller horsepower compressor unit resulting in a decrease in the physical size and operating cost of the system.

12 Claims, 1 Drawing Sheet

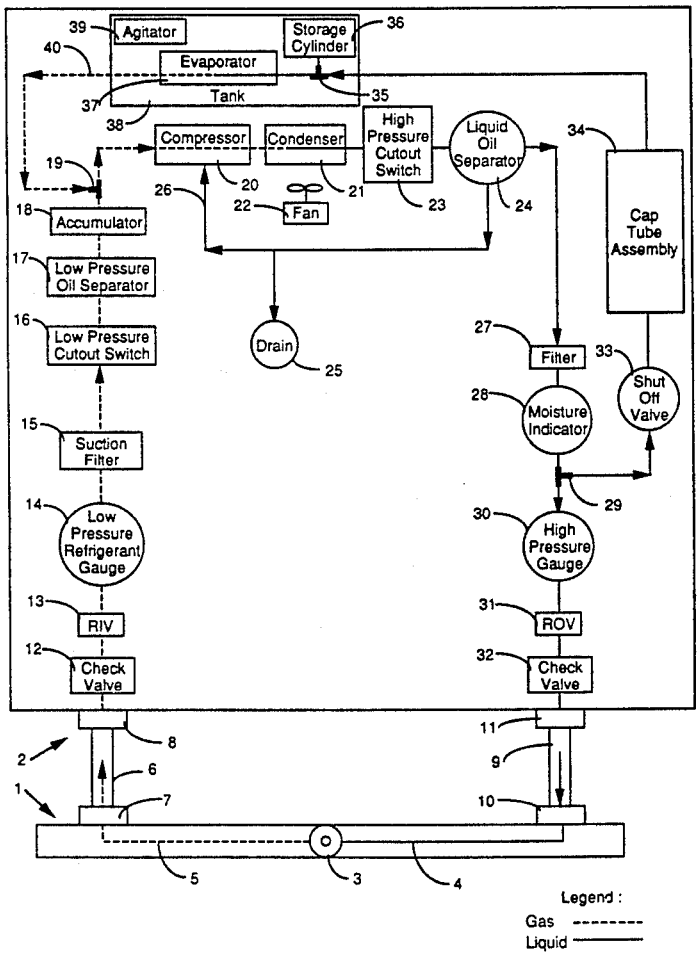

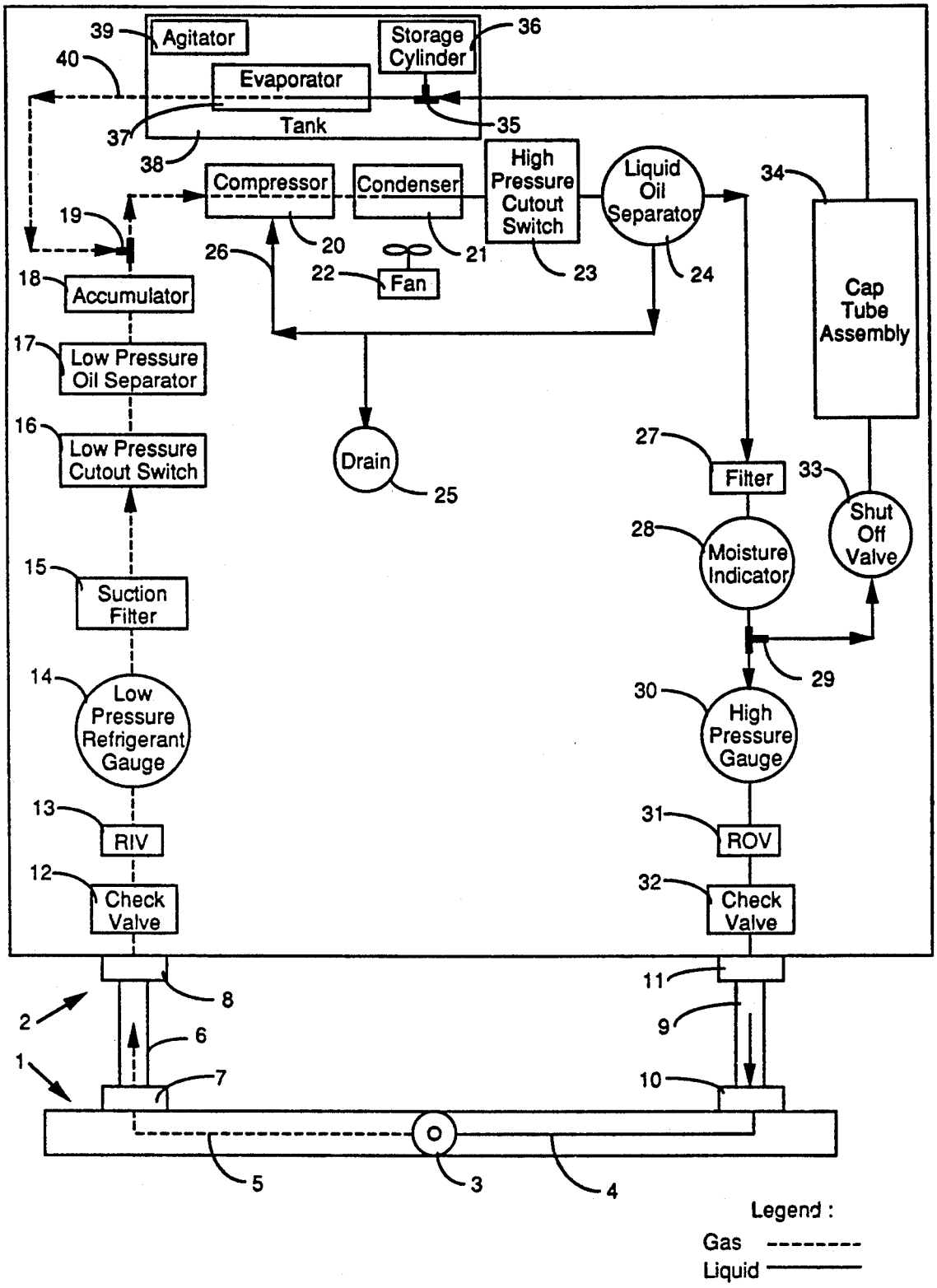
Agitator
Storage Cylinder
Evaporator
Tank
Compressor
Condenser
High Pressure Cutout Switch
Liquid Oil Separator
Fan
Accumulator
Low Pressure Oil Separator
Low Pressure Cutout Switch
Suction Filter
Low Pressure Refrigerant Gauge
RIV
Check Valve
Drain
Cap Tube Assembly
Filter
Moisture Indicator
Shut Off Valve
High Pressure Gauge
ROV
Check Valve
Legend :
Gas
Liquid

REFRIGERANT RECLAIMING AND RECYCLING SYSTEM WITH EVAPORATOR CHILL BATH

FIELD OF INVENTION

The present invention relates to a refrigerant recycling and reclaiming system capable of removing refrigerant from a refrigeration machine for filtering and reclaiming of the refrigerant, whereupon the refrigerant can be either stored or reintroduced into the refrigeration machine and reused rather than being lost to the atmosphere or otherwise wasted.

BACKGROUND OF THE INVENTION

It is well-known that the broad class of refrigerants presently used in refrigeration units known in the art, particularly those which consist of chlorofluorocarbons (CFC), can have a deleterious effect on the earth's ozone layer. One of the major sources of exposure of the atmosphere to such CFC's occurs during the servicing of such refrigeration units, when the refrigerant contained within the refrigeration unit is typically vented into the atmosphere when such units are disassembled for service. When repairs have been completed, such refrigeration units must then be recharged with fresh refrigerant, resulting in increased service costs.

Attempts have been made in the art to avoid wasting the refrigerant contained within the refrigeration unit by capturing that refrigerant, filtering and reclaiming it, and subsequently either storing the reclaimed refrigerant or reintroducing it into the refrigeration unit for further use. Examples of such systems include U.S. Pat. Nos. 4,110,998; 4,261,178; 4,285,206; 4,304,102; 4,363,222; 4,364,236; 4,441,330; 4,476,688, 4,480,446; 4,539,817; 4,554,792; 4,646,527; 4,688,388; 4,766,733; 4,768,347; 4,805,416; 4,809,515; 4,809,520; 4,856,289; 4,856,290; 4,862,699; 4,887,435; 4,903,499 and 4,909,042.

The refrigerant recycling and reclaiming systems of the prior art share the limitation of operating at substantial temperatures and pressures which, in turn, dictates the need for large horsepower compressors capable of working with the elevated pressures. These larger horsepower compressors, in turn, have higher operating costs and cause such systems to be larger and less portable than would otherwise be necessary. Thus, a need has arisen in the art for refrigerant recycling and reclaiming systems capable of operating at lower temperatures and pressures, utilizing lower horsepower compressors with the advantages attendant thereto.

It is an object of the present invention to allow compressors of different sizes to be used depending on the properties of the system being serviced. It is a further object of the present invention to remove oil and moisture from the refrigerant being reclaimed. It is a further object of the present invention to improve cleansing of the refrigerant being recycled by providing filter dryers on both the input and output sides of the system. It is a further object of the present invention to prevent the compressor from being slugged so that it may receive a steady flow of refrigerant. It is a further object of the present invention to permit reclaiming to proceed rapidly even under heavy load conditions. It is a further object of the present invention to simplify the reclaiming process by reduce the number of hose connections and disconnections required over those of prior art systems. It is a further object of the present invention to improve cost and safety of operation by utilizing low pressures within the reclaiming system.

SUMMARY OF THE INVENTION

A refrigerant recycling and reclaiming system is provided which includes an evaporator and/or refrigerant storage tank which are contained within a thermal barrier, typically a water bath, which permits the system to operate at lower temperatures and pressures than systems heretofore known in the art. Lower temperatures and pressures, in turn, require a much smaller horsepower compressor unit resulting in a decrease in the physical size and operating cost of the system.

BRIEF DESCRIPTION OF THE DRAWING

FIG. 1 is a schematic and representational showing of a recycling and reclaiming system in accordance with the present invention.

DESCRIPTION OF THE PREFERRED EMBODIMENTS

Referring now to FIG. 1, one embodiment of the refrigerant reclaiming and recycling system of the present invention is shown. Prior to being reclaimed and recycled by the system of the present invention, the refrigerant to be reclaimed and recycled is contained within a refrigeration system or machine, generally designated as reference numeral 1. The refrigerant is transferred from refrigeration machine 1 to the recycling and reclaiming system of the present invention, generally designated as reference numeral 2, whereupon the refrigerant is reclaimed as described below. The refrigerant is then subsequently recycled back into refrigeration machine 1 when desired, and reused.

Refrigeration machine 1 typically includes the usual compressor 3 having a low pressure side 4 and a high pressure side 5.

Recycling and reclaiming system 2 is connected to refrigeration machine 1 by connecting a pair of refrigerant conduits or hoses 6, 9 between refrigeration machine 1 and recycling and reclaiming system 2.

A first refrigeration hose 6 having a first and second end is connected at its first end to fitting 7 on the "high pressure" side of refrigeration machine 1 and at its second end to fitting 8 of the recycling and reclaiming system 2. Fitting 8 is preferably a Schrader-like valve, such as the Access Valve available from Wagner Co. of Miami, Fla. Any fitting is suitable which allows for easy connection of the refrigerant hose 6 between refrigeration machine 1 and recycling and reclaiming system 2.

A second refrigeration hose 9, also having a first and second end, is connected at its first end to fitting 10 on the "low pressure" side of refrigeration machine 1 and is connected at its second end to fitting 11 of recycling and reclaiming system 2. Like fitting 8, fitting 11 is also preferably a Schrader-like valve.

The refrigerant is transferred from refrigeration machine 1 and flows to and through the various components of the recycling and reclaiming system 2 for recycling and reclaiming as described below. In the following discussion of the flow of the refrigerant as it travels through the various components of recycling and reclaiming system 2, it is to be assumed that these components are in fluid communication to permit the flow of the refrigerant between the components, using typical fluid communication means well-known in the art. The fluid communication means does not form a part of the present invention, and will not be discussed in detail.

During initial start-up, a vacuum is drawn within the recycling and reclaiming system 2 by connecting a standard charging manifold (not shown) to fitting 11 and to a vacuum pump (not shown). The vacuum functions to remove condensables such as air. The vacuum pump is activated and begins to draw a vacuum, whereupon refrigerant inlet valve ("RIV") 13 is then opened and the vacuum is drawn within recycling and reclaiming system 2. The amount of vacuum will vary with the size of recycling and reclaiming system 2. In one embodiment of the present invention, the vacuum was on the order of 25 microns.

After obtaining a vacuum in recycling and reclaiming system 2, RIV 13 is opened. The operation of this, and all other valves of the recycling and reclaiming system 2, can be pneumatic, manual or electrical solenoid-type valves. The refrigerant flows in the direction of the vacuum created within recycling and reclaiming system 2, from the high pressure side of refrigeration machine 1, through fitting 7, through the first refrigeration hose 6, through fitting 8 and into recycling and reclaiming system 2. (FIG. 1 depicts the refrigerant in a gaseous state at this point for ease of discussion, although the refrigerant could be a liquid, a gas, or a combination of both, as it passes into recycling and reclaiming system 2 at this point.)

After the refrigerant passes through fitting 8, it next passes though check valve 12. The check valve 12 prevents the refrigerant from flowing back into refrigeration machine 1.

The refrigerant next passes through RIV 13. RIV 13 is used to start and stop the input of the refrigerant into recycling and reclaiming system 2, as desired or required.

After passing through RIV 13, the refrigerant passes through a low pressure refrigerant gauge 14. Gauge 14 is used to monitor incoming refrigerant pressure and also tells the system operator when the system has been reclaimed. Initially, the gauge will read above zero indicating pressure is present. As the refrigerant enters recycling and reclaiming system 2, the pressure registering on gauge 14 drops. The recycling and reclaiming system 2 has been reclaimed when gauge 14 reads approximately zero pressure.

The refrigerant will flow to and through a suction filter 15 which will remove any large contaminants such as moisture and oil contaminants.

The refrigerant next flows through low pressure cutout switch 16, which stops the operation of the recycling and reclaiming system 2 when the pressure in refrigeration machine 1 reaches zero pounds per square inch pressure. If the suction filter 15 is not functioning properly, it can create too large a vacuum at that point within the recycling and reclaiming system 2. Low pressure cutout switch 16 serves to protect the recycling and reclaiming system 2 from going into a vacuum, which could cause unwanted oil sludge to be drawn into filter 15.

The refrigerant next passes through low pressure oil separator 17. The low pressure oil separator 17 will separate contaminant oil from the refrigerant.

The refrigerant next passes through suction line accumulator 18. Accumulator 18 functions to protect compressor 20, described below, from being slugged by a water hammer effect from the liquid component of the refrigerant and/or oil.

As the refrigerant continues flowing, it will pass over a tee 19, which allows for the return of the refrigerant from evaporator 37, as discussed below.

The refrigerant next enters compressor 20 where it will be compressed down to a high pressure gas. The compressor 20 is very important in the recycling and reclaiming system 2 of the present invention because the compressor 20 can be changed according to the needs of the refrigeration machine 1 being reclaimed. For instance, in the beverage industry a small bottler may need only a 1/5 h.p. compressor, and may only recover 5 or 10 pounds of refrigerant per year. On the other hand, reclaiming an air conditioning and refrigeration system, such as those used in buildings or automobiles, may require a 1 h.p. compressor and may recover hundreds or thousands of pounds of refrigerant per year. The recycling and reclaiming system 2 of the present invention differs from systems known in the art in that it can use a lower horsepower compressing unit to perform the same functions that required larger compressors in the prior art. This is because the recycling and reclaiming system 2 of the present invention operates at lower pressures because the system uses an evaporator in a water bath compartment as explained more fully below. Lower pressures mean a more economical and safer operation, plus a lower operating cost. For example, a typical system known in the prior art would require a ½ h.p. compressor and would operate at pressures of 300 pounds per square inch, whereas the present invention can perform the same function at approximately 200 pounds per square inch pressure with a ⅓ h.p. compressor. Alternatively, using a ½ h.p. compressor would allow for faster recovery and reclaiming times over those utilizing prior art recycling and reclaiming systems. In an actual embodiment of the present invention, a 1/5 h.p. compressor was used and the system pressure was approximately 100 pounds per square inch with water in the water bath. This rose to approximately 125 pounds per square inch with no water in the water bath.

After leaving compressor 20, the high pressure gaseous refrigerant will enter condenser 21 where the gaseous refrigerant will be condensed to a liquid state. The condenser is the main source of heat exchange, wherein the heat imparted to the refrigerant during the compression stage (which converts substantially all of the refrigerant to a gaseous state in compressor 20) is given off, and the refrigerant is cooled to a high pressure liquid state. Fan 22 is used to increase the air flow over cooling fins of condenser 21 to increase the efficiency of the cooling of the refrigerant. The use of a large condenser further improves heat exchange and speeds operation of the system under heavy loads.

Upon leaving condenser 21, the refrigerant passes through high pressure cutout switch 23. High pressure cutout switch 23 protects compressor 20 from excessive head pressures, and will shut-off the operation of compressor 20 when the head pressure, which is defined as that pressure generated by compressor 20 at the condenser 21, reaches a predetermined level. For example, in one embodiment of the present invention, a head pressure of 300 pounds per square inch caused high pressure cutout switch 23 to terminate the operation of compressor 20.

The refrigerant next passes through liquid/oil separator 24. The liquid/oil separator 24 will remove any remaining oil from the liquid refrigerant. The oil will remain at the bottom of the oil separator 24 until drained at some future date through drain 25. Drain 25 typically includes a Schrader-like valve. In an alternative embodiment of the present invention, liquid/oil separator 24 also has associated with it oil return line 26 which is used, as desired, to return oil to compressor 20 to maintain lubricating oil within compressor 20 to prevent compressor 20 from freezing or locking-up due to a lack of lubricant. While oil return line 26 is shown as entering compressor 20 directly, if compressor 20 is not so equipped to receive oil return line 26 directly, oil return line 26 could alternatively return oil to the fluid communication means immediately in front of compressor 20 so as to allow oil to enter compressor 20 via that route.

Upon exiting liquid/oil separator 24, the refrigerant next passes through filter 27, which is a liquid filter used to filter the refrigerant in its liquid state to remove moisture or acid left in the refrigerant.

Upon leaving filter 27, the refrigerant flows through moisture indicator 28. The moisture indicator 28 is important because it will change color if an excessive amount of water passes over the indicator 28 which will help to diagnose problems within the system.

The refrigerant then passes over tee 29, which in one embodiment of the present invention includes a valve assembly which allows for the choice of: 1) directing the refrigerant out of recycling and reclaiming system 2 and returning the refrigerant to refrigeration machine 1; or 2) directing the refrigerant to evaporator 37 and/or storage tank 38, discussed in detail below.

When the choice is made by the operator to direct the refrigerant out of recycling and reclaiming system 2 and reintroduce the refrigerant into refrigeration machine 1, the refrigerant, upon passing through tee 29, next flows through high pressure gauge 30, where the refrigerant pressure can be read.

The refrigerant next flows through refrigerant outlet valve ("ROV") 31. When ROV 31 is open, the refrigerant flows through ROV 31 through check valve 32. The check valve 32 prevents any refrigerant from back flowing into recycling and reclaiming system 2. After check valve 32, the refrigerant flows through fitting 11, through refrigerant hose 9 whereupon it reenters refrigeration machine 1 through fitting 10, recycled and reclaimed, ready for future use by refrigeration machine 1.

When the choice is made by the operator to direct the refrigerant into the evaporator 37 and/or storage cylinder 36, the valve assembly associated with tee 29 is manipulated to permit the refrigerant to flow to evaporator shut off valve 33.

In an alternative embodiment of the present invention, tee 29 could be a simple tee assembly without any associated valve assembly, whereupon the closing of ROV valve 31 would have the effect of directing the refrigerant to flow to evaporator shut-off valve 33. When the operator chooses to direct the refrigerant through evaporator 37, the operator opens evaporator shut-off valve 33, whereupon the refrigerant flows through cap tube assembly 34 to evaporator 37. Cap tube assembly 34 connects the high and low sides of recycling and reclaiming system 2 together, allowing both sides to equalize.

In addition, when closed, the evaporator shut-off valve 33 will increase the head pressure and when open, it will lower the head pressure, thus evaporator shut-off valve 33 can be used by the operator to increase or decrease the pressure of the refrigerant entering refrigeration machine 1 when ROV 31 is open.

Cap tube assembly 34 permits the high pressure liquid refrigerant to expand, whereupon the expanding refrigerant begins its conversion to a gaseous state, and experiences a substantial drop in temperature.

The refrigerant then flows over tee 35. Tee 35 includes a directional valve assembly which allows the operator the choice of directing the primarily liquid, low temperature, low pressure refrigerant into storage cylinder 36 for storage, or through evaporator 37. In a preferred embodiment of the present invention, storage cylinder 36 also includes a sensor to indicate when the storage cylinder is approaching its capacity, whereupon the sensor will automatically suspend the operation of recycling and reclaiming system 2 when the sensor reaches a preset level.

Both storage cylinder 36 and evaporator 37 are contained within tank 38. Tank 38 is any tank known in the art which is capable of holding a liquid. In a preferred embodiment, tank 38 is insulated and/or capable of forming a thermal barrier between the interior of tank 38 and the ambient atmosphere.

In a preferred embodiment of the present invention, tank 38 contains a sufficient amount of water or similar substance so as to provide a water bath for storage cylinder 36 and evaporator 37. Also, in a preferred embodiment, tank 38 includes access to a water supply and a sensor for controlling the water flow into tank 38 to ensure that tank 38 maintains a constant level of water within tank 38. Also contained within tank 38 is optional agitator 39 which functions to continuously circulate the water or similar substance within tank 38 to assure maximum uniformity of the temperature of the water within the water bath, and maximum heat exchange.

In operation, the evaporator 37 is a heat exchanger which is independent of the condenser. The rapidly expanding, cooling refrigerant picks up heat from the surrounding water bath as it passes through evaporator 37, whereupon the refrigerant assumes a low pressure, higher temperature gaseous state. In return, the water in the water bath is cooled substantially. Typically, temperatures as low as 20° F. are achieved within the water bath. Because the evaporator 37 and storage cylinder 36 are located within the water bath within tank 38, the heat exchange taking place within the water bath will lower the temperature of all components within the water bath, and consequently, the pressure of the refrigerant in both the evaporator 37 and the storage cylinder 36. This lowering of temperature and pressure within evaporator 37 and storage cylinder 36 permits the recycling and reclaiming system 2 of the present invention to use a lower horsepower compressing unit to perform the same functions that required larger compressors in the prior art. Lower pressures also mean a more economical and safer operation, plus a lower operating cost.

In an alternative embodiment of the present invention, tank 38 contains only air. The air around tank 38 also functions as a heat exchanger if the area is closed off from the ambient temperature. Ice or any similar cooling substance can also be used and packed within tank 38 around storage cylinder 36 and evaporator 37 to further assist in the reduction of the temperature within each of them.

As the refrigerant continues its flow through evaporator 37, it will flow as a gas through line 40, reentering the system at tee 19 forming a looped system when RIV 13 and ROV 31 are closed and evaporator shut-off valve 33 is open.

When the operator seeks to break the looped system, evaporator shut-off valve 33 is closed, and/or tee 29 is manipulated so as to direct the flow of the refrigerant through high pressure gauge 30 and into refrigeration machine 1 as previously detailed.

When the operator seeks to reintroduce the refrigerant stored in storage cylinder 36 to the recycling and reclaiming system 2, the operator simply manipulates the valve assembly associated with tee 35, to allow refrigerant to flow from storage cylinder 36, and removes storage cylinder 36 from the water bath, whereupon the refrigerant stored therein will return to a gaseous state. At this point, the refrigerant will flow through tee 35, evaporator 37, line 40, tee 19 and the remainder of the system components, ultimately passing through ROV 31 into refrigeration machine 1, as detailed above.

The type of refrigerant being reclaimed has a direct effect on evaporator temperature. The recycling and reclaiming system of the present invention is capable of reclaiming virtually all types of refrigerant, including types 12, 22 and 502. In addition, the compressor 20 of the recycling and reclaiming system 2 of the present invention can be easily changed to meet the demands of the particular application. In many applications, the storage cylinder 36 may be unnecessary, as the reclaiming system holds approximately 14 pounds of refrigerant depending upon the ambient temperature. Other advantages of the present invention include that the addition of the check valves 12, 32 and low pressure cutout switch 17 enables the operator to permit the system 2 to run unattended. The low pressure cutout switch will automatically shut down the recycling and reclaiming system 2 when the refrigeration machine 1 has been reclaimed, and the check valves 12 and 32 will prevent unwanted back flow of refrigerant.

The present invention differs from prior art devices in the following respects:

a) arrangement and sequencing of components;

b) choice of components that are in physical contact or close proximity to create a heat exchange relationship;

c) method of withdrawing refrigerant from the unit to be evacuated;

d) method of re-introducing refrigerant into the unit which has been serviced;

e) method of boiling the refrigerant prior to condensation;

f) use of a water bath to improve efficiency of operation;

g) number, choice and location of filtration and separation devices in the system;

h) storage tank design and location;

i) monitoring devices, such as pressure gauges, overfill detectors, cut-off switches, moisture indicators, etc.; and j) size, weight, storage capacity and other factors affecting efficiency and portability.

The refrigerant reclaiming and recycling system of the present invention provides many features and advantages over prior art devices.

For example, U.S. Pat. No. 4,110,998 describes a device to be added to a refrigeration system to remove contaminants as the system is being operated. The present invention does not require the unit being serviced to be operated during reclaiming. In fact, it is an advantage of the present invention that it can be used to reclaim refrigerant from a system that is not operational.

U.S. Pat. No. 4,261,178 describes a non-recirculating refrigerant removal and recharging system. The present invention is recirculating, which allows repetitive cleansing of the refrigerant.

U.S. Pat. No. 4,285,206 describes a non-recirculating apparatus for removing and restoring refrigerant from an air conditioner. It requires an evaporator means coupled between the input line and the pump to vaporize refrigerant. The present invention is recirculating and requires no evaporator on its input line since it draws refrigerant from the gaseous side of the unit being serviced.

U.S. Pat. No. 4,304,102 describes a recycling refrigerant purging system utilizing twin purge containers and continuously flowing cooling water to condense contaminants from the refrigerant. The present invention does not require either two purge chambers or flowing water.

U.S. Pat. No. 4,363,222 describes a non-recirculating refrigerant removal and recharging system requires a refrigerant supply container, which is not used by the present invention.

U.S. Pat. Nos. 4,364,236 and 4,441,330 describe a method and apparatus for servicing a refrigeration system to remove oil contaminants from the refrigerant and recharge the system with both oil and refrigerant. The present invention does not involve means for reintroducing oil to the unit being serviced.

U.S. Pat. No. 4,476,688 describes a refrigerant recovery and purification system having a condenser and evaporator in heat exchange relationship so that the cooling of refrigerant in the condenser boils liquid refrigerant in the evaporator. In the present invention, the condenser 21 is not in heat exchange relationship with evaporator 37.

U.S. Pat. No. 4,480,446 describes a refrigerant recovery and purification system utilizing a particular two-section storage tank design useful in separating contaminants. In the present invention, such a separating tank is not required.

U.S. Pat. No. 4,539,817 describes a method and apparatus for recovering refrigerant from and also charging a system that is in operation. It requires heat exchange coils within its storage container in direct contact with the refrigerant, whereby the refrigerant is cooled internally to the storage container. In the present invention, the storage container is cooled externally.

U.S. Pat. No. 4,554,792 describes a method for refrigerant recovery and purification in which the storage tank is connected directly to the unit being serviced through a filter and in which the unit operates during servicing. In the present invention, the unit being serviced need not be operational and the refrigerant is compressed prior to being introduced into the storage tank.

U.S. Pat. No. 4,646,527 describes an apparatus and method for refrigerant recovery and purification that requires a refrigerant accumulator between the input line and the compressor. The present invention does not require such an accumulator.

U.S. Pat. No. 4,688,388 describes a microprocessor-controlled refrigeration service station having a keypad and alphanumeric display panel. It dispenses measured quantities of refrigerant back into the unit being serviced under program control. The present invention is much simpler and requires no microprocessor.

U.S. Pat. No. 4,766,733 describes a refrigerant recovery system in which refrigerant from the unit to be serviced is drawn directly through a filter into a storage tank and refrigerant in re-introduced to the unit being serviced by mixing high-pressure gaseous refrigerant with liquid refrigerant to cause the refrigerant to flow. In the present invention, refrigerant is first drawn through filter 15, oil separator 17, accumulator 18, compressor 20, condenser 21, liquid/oil separator 24, filter 27 and cap tube assembly 34 before entering storage cylinder 36. This results in greater cleaning of the refrigerant before it is stored. In the present invention, refrigerant is re-introduced back to the system being serviced by allowing it to boil instead of by mixing. U.S. Pat. No. 4,809,515 describes a refrigerant recovery system requiring a precharged tank of refrigerant of the type to be recovered. The present invention may be operated with an empty storage tank or no storage tank at all. No storage tank is required if the capacity of the system of the present invention is large enough to contain all the refrigerant being reclaimed.

U.S. Pat. No. 4,856,289 describes an apparatus for reclaiming and purifying hydrocarbon refrigerants requiring a heated still for vaporizing the refrigerant, a superheater and a non-vaporizing sub cooler, none of which are required with the present invention.

U.S. Pat. No. 4,856,290 describes a refrigerant reclaiming apparatus intended to be used while the unit being serviced is operating. It uses no compressor, but operates by periodically withdrawing working fluid from the unit being serviced. It requires a liquid pump and a jet pump connected to a common liquid inlet, a liquid level control and an electric resistance heater and associated thermostat, none of which are used in the present invention.

U.S. Pat. No. 4,862,699 describes an apparatus for separating refrigerant from lubricant, but which reintroduces refrigerant and lubricant to the unit being serviced. It requires a bypass to allow refrigerant to continue cycling through the unit being serviced as portions of refrigerant are reclaimed and a heater to warm the storage reservoir, neither of which is used in the present invention. It also allows lubricant into the storage reservoir, which does not occur with the present invention.

U.S. Pat. No. 4,887,835 describes an method for cleaning and flushing a refrigeration system. It requires disconnection of the compressor of the unit being serviced and attachment of inlet and exit lines previously connected to the compressor to the cleaning unit to achieve a continuous flow through both the unit being serviced and the cleaning unit. It also discloses operating the system being serviced during cleaning. None of these steps is required by the present invention.

U.S. Pat. No. 4,903,499 describes a refrigerant recovery system comprising a hollow annular jacket whose surface in in thermal communication with a pressure vessel and means in fluid communication with said jacket. No such jacket is required by the present invention.

U.S. Pat. No. 4,909,042 describes a microprocessor-controlled air conditioner charging station requiring a microprocessor to operate an electronic sequencing means for charging the unit being serviced. The present invention may be operated entirely with manual valves and does not require a microprocessor.

It is to be appreciated that various modifications to the inventive concepts may be apparent to those skilled in the art without departing from the scope and spirit of the invention as embodied in the following claims.

I claim:

1. A refrigerant recovery apparatus for recovering compressible refrigerant from a refrigeration system having a high pressure side and a low pressure side comprising:

first fluid carrying line means, a first end of said first line means adapted for fluid communication with the high pressure side of the refrigeration system and a second end of said first line means adapted for fluid communication with a compressor means;

second fluid carrying line means, a first end of said second line means being in fluid communication with said compressor means and a second end of said second line means adapted for fluid communication with an evaporator means and refrigerant storage means;

a thermal barrier means surrounding said evaporator means and said storage means wherein said thermal barrier means further comprises a means to retain at least one of water, air or ice interiorly of said thermal barrier means and exteriorly of said evaporator means, to thereby assist in reducing the temperature within said evaporator means and said storage means;

third fluid carrying line means, a first end of said third line means adapted for fluid communication with said evaporator means and a second end of said third line means adapted for fluid communication with said first line means; and fourth fluid carrying line means, a first end of said fourth line means adapted for fluid communication with said second line means downstream of said compressor means and a second end of said fourth line means adapted for fluid communication with the low pressure side of the refrigeration system to re-introduce refrigerant into the refrigeration system.

2. The apparatus of claim 1, wherein said thermal barrier means surrounding said evaporator means further comprises a means to retain water, air or ice interiorly of said thermal barrier and exteriorly of said evaporator means.

3. The apparatus of claim 2, further comprising an agitating means disposed within said thermal barrier means.

4. An apparatus for recovering compressible refrigerant from a refrigeration system having a high pressure side and a low pressure side comprising:

first fluid carrying line means, a first end of said first line means adapted for fluid communication with the high pressure side of the refrigeration system and a second end of said first line means adapted for fluid communication with a compressor means, said first line means comprising in successive downstream sequence:

first check valve;
refrigerant inlet valve;
low pressure refrigerant gauge;
suction filter;
low-pressure oil separator;
suction line accumulator;
first tee connector; and
said compressor means;

second fluid carrying line means, a first end of said second line means being in fluid communication with said compressor means and a second end of said second line means adapted for fluid communication with an evaporator/storage means, said second line means comprising in successive downstream sequence:

condenser means;
high pressure cutout switch;
liquid/oil separator;
moisture/acid filter;
moisture indicator;
second tee connector;
evaporator shut-off valve;
cap tube assembly; and
evaporator means;

third fluid carrying line means, a first end of said third line means adapted for fluid communication with said evaporator means and a second end of said third line means adapted for fluid communication with said first tee connector; and fourth fluid carrying line means, a first end of said fourth line means adapted for fluid communication with said second tee connector and a second end of said fourth line means adapted for fluid communication with the low pressure side of the refrigeration system to re-introduce refrigerant into the refrigeration system, said fourth line means comprising in successive downstream sequence:

high pressure gauge;
refrigerant outlet valve; and
second check valve.

5. The apparatus of claim 4, further comprising fifth fluid carrying line means, a first end of said fifth line means adapted for fluid communication with said liquid/oil separator means and a second end of said fifth line means adapted for fluid communication with said compressor, said fifth line means further comprising a drain for collecting liquids or oil from said liquid/oil separator.

6. The apparatus of claim 10, wherein said second fluid carrying line means further comprises:

a storage means downstream of said cap tube assembly;

a third tee connector downstream of said cap tube assembly and upstream of said storage means and said evaporator means, wherein said third tee connector permits the directing of said refrigerant from said cap tube assembly to either said evaporator means or said storage means;

a thermal barrier means surrounding said storage means and said evaporator means wherein said evaporator means and said storage means are thermally insulated from the ambient atmosphere and are maintained in a heat exchange relationship with one another.

7. A refrigerant recycling and reclaiming system for removing refrigerant from a refrigeration machine, cleansing said refrigerant of contaminants and converting said refrigerant to a liquid state for storage or subsequent return to said refrigeration machine, comprising in fluid combination:

a first means for transferring said refrigerant from said refrigeration machine to said recycling and reclaiming system;

a check valve downstream of said first means;

a refrigeration inlet valve (RIV) downstream of said check valve;

a low pressure refrigerant gauge downstream of said RIV;

a suction filter downstream of said low pressure refrigerant gauge;

a first tee downstream of said low pressure refrigerant gauge, wherein said tee receives the flow of said refrigerant from either said suction filter or from an evaporator;

a low pressure cutout switch downstream of said suction filter;

an accumulator downstream of said low pressure cutout switch;

a compressor means downstream of said accumulator;

a condenser means downstream of said compressor;

a high pressure cutout switch downstream of said condenser;

a liquid/oil separator downstream of said high pressure cutout switch;

a liquid filter downstream of said high pressure cutout switch;

a moisture indicator downstream of said high pressure cutout switch;

a second tee downstream of said high pressure cutout switch wherein said second tee permits the directing of said refrigerant to either a high pressure gauge or an evaporator shut-off valve downstream of said second tee;

a refrigeration outlet valve downstream of said high pressure gauge;

a check valve downstream of said refrigeration outlet valve;

a second means for transferring said refrigerant from said recycling and reclaiming system to said refrigeration means;

a cap tube assembly downstream of said evaporator shut-off valve;

an evaporator downstream of said expansion valve;

a fluid communication line downstream of said evaporator wherein said line directs said refrigerant to said first tee;

a tank surrounding said evaporator, wherein said tank forms an insulated thermal barrier around said evaporator and wherein said tank is capable of retaining a liquid to form a water-like bath surrounding said evaporator; and an agitator contained with said tank.

8. The recycling and reclaiming system of claim 7, wherein said system further comprises:

a third tee downstream of said expansion valve, wherein said third tee permits the directing of the flow of said refrigerant to either said evaporator or to a storage cylinder downstream of said tee, wherein said storage cylinder is contained within said tank.

9. The recycling and reclaiming system of claim 7, wherein said system further comprises a drain in fluid communication with oil retained within said liquid/oil separator, wherein said drain permits the draining of oil from said liquid/oil separator.

10. The recycling and reclaiming system of claim 7, wherein said system further comprises an oil return line, said oil return line having a first and second end, wherein said first end is in fluid communication with oil retained within said liquid/oil separator, and wherein said second end is in fluid communication with said compressor, wherein said oil return line permits the transfer of oil retained within said liquid/oil separator to said compressor.

11. The recycling and reclaiming system of claim 7, wherein said system further comprises a fan, said fan producing a sequential flow of ambient air over said condenser.

12. The recycling and reclaiming system of claim 7, wherein said system further comprises a low pressure oil separator downstream of said low pressure cutout switch.

* * * * *

UNITED STATES PATENT AND TRADEMARK OFFICE

CERTIFICATE OF CORRECTION

PATENT NO. : 5,327,735

DATED : July 12, 1994

INVENTOR(S) : Bobby L. Hatton

It is certified that error appears in the above-indentified patent and that said Letters Patent is hereby corrected as shown below:

Claim 6 Line 41 Column 11 "10" should read --4--.

Signed and Sealed this

Eighteenth Day of October, 1994

Bruce Lehman

*Attest:*

BRUCE LEHMAN

*Attesting Officer*

*Commissioner of Patents and Trademarks*